US008137149B2

(12) United States Patent
Hui

(10) Patent No.: US 8,137,149 B2
(45) Date of Patent: Mar. 20, 2012

(54) INTERACTIVE DOLL

(76) Inventor: Man Kit Hui, Hong Kong (HK)

( * ) Notice: Subject to any disclaimer, the term of this patent is extended or adjusted under 35 U.S.C. 154(b) by 1180 days.

(21) Appl. No.: 11/924,611

(22) Filed: Oct. 26, 2007

(65) Prior Publication Data

US 2009/0111352 A1 Apr. 30, 2009

(51) Int. Cl.
*A63H 30/00* (2006.01)
*A63H 3/00* (2006.01)

(52) U.S. Cl. ..... 446/175; 446/268; 446/297; 446/397; 446/454

(58) Field of Classification Search ..... 446/175, 446/268, 299, 270, 330–331, 454–456
See application file for complete search history.

(56) References Cited

U.S. PATENT DOCUMENTS

| | | | | |
|---|---|---|---|---|
| 4,964,837 | A * | 10/1990 | Collier | 446/409 |
| 6,758,716 | B1 * | 7/2004 | Rehkemper et al. | 446/297 |
| 2002/0173219 | A1 * | 11/2002 | Kilstrom | 446/454 |
| 2006/0079147 | A1 * | 4/2006 | Wong et al. | 446/142 |
| 2007/0249422 | A1 * | 10/2007 | Podoloff | 463/43 |
| 2008/0160877 | A1 * | 7/2008 | Lipman | 446/268 |

* cited by examiner

*Primary Examiner* — Dmitry Suhol
*Assistant Examiner* — Alex F. R. P. Rada, II
(74) *Attorney, Agent, or Firm* — Eric Hanscom; Todd J. Langford

(57) ABSTRACT

An interactive doll is disclosed where the doll is controlled by a remote control. When the user pushes a button on the remote control, it can cause the doll and the remote control to interact via electromagnetic transmissions where both emit sounds simultaneously or at different times. The remote control can represent various items, including mobile phones and birthday cakes.

26 Claims, 9 Drawing Sheets

INTERACTIVE DOLL

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of toy dolls, and more specifically toward an interactive doll where the doll is controlled by a remote control. When the user pushes a button on the remote control, it can cause the doll and the remote control to interact via electromagnetic transmissions where both emit sounds simultaneously or at different times. The remote control can represent various items, including mobile phones and birthday cakes.

Dolls have been around for thousands of years, mainly as toys for small children. As times have progressed, these dolls have become more and more sophisticated. Batteries and electronics have been added to these dolls, as well as moving parts. Children and parents continue to expect more technologically advanced features present in the dolls they purchase. With this, they expect dolls to reflect current societal interests and practices.

Mobile phones have become common tools around the world. Individuals of all ages use cell phones and interact with them every day. There are even mobile phones specifically designed for young children.

Many people celebrate birthdays with birthday cakes. The birthday boy or girl often gets a cake with one or more lit candles on top. The participants in the celebration sing a song, and at the conclusion, the birthday boy or girl blows out the candles.

Some dolls have been designed to represent these events. However, these dolls lack sound and lights that create a more realistic and entertaining toy. Further, these dolls are not controlled by wireless remotes that allow the user to control and participate in the social interest or practice.

Thus there has existed a long-felt need for a technologically advanced doll that not only reflects current societal interests and practices, but also entertains children of various ages. The doll must be interactive and respond to various commands, and give feedback to the user. Further, the doll should be designed so that it is safe to use and will also operate for an extended period of time without excessive power requirements.

The current invention provides just such a solution by having an interactive doll where the doll is controlled by a remote control. When the user pushes a button on the remote control, it can cause the doll and the remote control to interact via electromagnetic transmissions where both emit sounds simultaneously or at different times. The remote control can represent various items, including mobile phones and birthday cakes.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

SUMMARY OF THE INVENTION

This invention is a toy doll where the user can interact with the doll by using a remote control.

The doll and the remote control interact via electromagnetic transmissions that travel from the remote control to the doll. When the user presses a button on the remote control, the remote control can emit sound, transmit an electromagnetic transmission, or both. The doll, depending on the electromagnetic transmission that it receives, emits a particular sound. These sounds can be short or long in duration, and comprise of words, music, or both. By combining a series of electromagnetic transmissions and sounds, conversations, songs, parties, and many other social interests and practices can be replicated.

The interaction between the remote control and the doll is achieved by electromagnetic transmissions, or more preferably, infrared light transmission. When the user presses a button on the remote control, infrared light is emitted from the infrared transmitter in the remote control. This light travels from the remote control to the doll. The doll receives this infrared light transmission in its infrared receiver. The circuitry located inside of the doll processes this infrared light transmission. Based on the input it receives, the circuitry causes the speaker to emit sound.

The doll is preferably powered by standard "AA" sized batteries. The remote control can be powered by standard "AA" sized batteries, or by "R44" sized batteries, depending on the size and power requirements of the remote control. The batteries are configured to meet the power requirements of the specific device.

Both the doll and the remote control include integrated circuits. These circuits receive input from various sources, such as from buttons, switches, microphones, or electromagnetic receivers. Based upon the input that it receives, the integrated circuit is pre-programmed to create output for various other electronic components, such as LEDs, speakers, or electromagnetic transmitters. By way of example, when a user presses a button, this button acts as input to the integrated circuit. The integrated circuit processes this input and sends an output to a component, such as a speaker. This output will cause the speaker to emit sound, such as a song or spoken words. Alternatively, the input could come from an electromagnetic receiver, where the electromagnetic receiver, upon receiving a transmission, sends this input to the integrated circuit. Depending on the input it receives, the integrated circuit will output a signal to the speaker to emit sound and will output a signal to the LED to emit light. Various input sources and output components can be used to create a wide variety of possibilities.

Once such embodiment of the invention is a toy doll where the doll has a mobile phone in one hand, and where the remote control also resembles a mobile phone. This embodiment is known as a "Mobile Phone Doll." The remote control mobile phone has buttons similar to those of real mobile phones, including a send button, an end button, a voicemail button, and the normal 1-9, star, and pound phone buttons. The send button and the end button are known as interactive buttons since they cause the remote control and the doll to interact. The other buttons that do not cause the remote control and the doll to interact are known as non-interactive buttons. When the user presses the send button, both the remote control mobile phone and the mobile phone that the doll is holding ring. Then the doll and the remote control mobile phone have a conversation. At any time, the conversation can end by simply pressing the end button on the remote control mobile phone. When the user presses the end button, the conversation stops and both the remote control mobile phone and the doll say goodbye. If the user presses the voicemail button, the remote control plays a sound recording as if the doll had called the remote control mobile phone and left a message. Further, any of the remaining 1-9, star, and pound buttons may be pressed and a beeping noise is emitted, similar to that of actual mobile phones.

The remote control can also have a light-producing object. The most favorable choice for a light source is a light emitting diode (LED) because of its efficiency and longevity. The light can blink or remain lit while the remote control is being operated, or when the remote control and the doll are interacting. Further, the mobile phone that the doll holds can also have a light-producing object. Similar to the remote control, an LED is preferred. It can also blink or remain lit when the doll is being operating or interacting with the remote control.

In the hand of the doll that does not hold a mobile phone there can be a hidden button. The button is not visible on the outside of the hand, but by pressing the palm, the button can be activated. The button serves various functions depending on the position of the three-way switch, described below.

The doll also has a three-way switch, preferably located near the power supply. The switch can be in the on, off, or limited-function positions. When the switch is in the off position, the doll is turned off, and will not function. It will not respond to infrared light transmissions from the remote, nor will it emit any sound or respond to any other input, such as from the button located in the hand. However, when the switch is in the on position, the power supply powers all of the various electrical components that require electricity. Assuming that the batteries in the power supply have a sufficient voltage potential, the doll will be fully functional and will interact with the remote control or any other input devices located in the doll. After a finite period of time, such as sixty seconds, where there is no interaction either from the remote control or the button in the hand, the doll will leave the normal-power mode and enter a low-power mode. In this mode, the doll will not respond to infrared light transmissions from the remote control. Power is not supplied to all of the various components that require electricity in efforts to conserve power and extend the useful life of the batteries. The doll can be returned to a normal-power mode by pressing the button in the hand of the doll. Finally, the switch can be in the limited-function, or "Try-Me" position. In this position, the doll has limited functionality. It will not respond to infrared transmissions from the remote control. However, if the button in the hand is pressed, parts of the conversation between the remote control and the doll are emitted from the doll. This allows potential buyers to hear particular words and phrases used by the doll while not quickly draining the power from the batteries.

Another embodiment of the invention is a toy doll where the doll is celebrating a birthday. In this embodiment, the remote control resembles a birthday cake. This embodiment is known as a "Birthday Doll." To make the remote control realistically depict a birthday cake, there is a candle that is removable from the remote control base. This candle, however, includes many important features. First of all, the placing of the candle into the remote control base activates the interaction between the remote control and the doll. In other words, the candle is a switch, known as a candle switch or removable interactive switch, where the user places the candle into the remote control base to close this switch. Closing the switch causes the electromagnetic transmitter, preferably an infrared light transmitter, to emit light. The doll receives this light transmission, and outputs sound accordingly. The effect is that when the candle is placed into the remote control, the doll and the remote control start the "Happy Birthday" song.

The candle can also include a light producing object, preferably an LED that lights up. It takes the place of the flame on top of the candle. When the candle is placed into the remote control it will light up as if the candle was lit. Once the "Happy Birthday" song is finished playing, the user can blow out the candle. To do this, the user blows onto the candle. The candle comprises a microphone that that can sense sound, such as the sound from air flowing around the candle. This input from the microphone causes the remote control and the doll to interact once again. Applause and congratulation sounds are emitted from both the doll and the remote control. An additional button can be placed on the remote control limiting the function of the microphone, known as a microphone activating button. In this instance, the microphone will only be activated when the user is depressing the button, thereby decreasing the chances of the microphone receiving other unintentional sounds and "blowing" out the candle.

As described above in the Mobile Phone Doll, the doll in this embodiment can also include a hidden button in the hand of the doll as well as a three-way switch. Further, the remote control itself can have an on-off button to conserve the batteries located inside of the remote control.

It is a principal object of the invention to provide a child's toy that reflects a current interest and practice of society.

It is another object of the invention to provide a child's toy that is fun and entertaining to use.

It is a final object of this invention to provide a child's toy that is safe and efficient to operate.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

Figure 1:
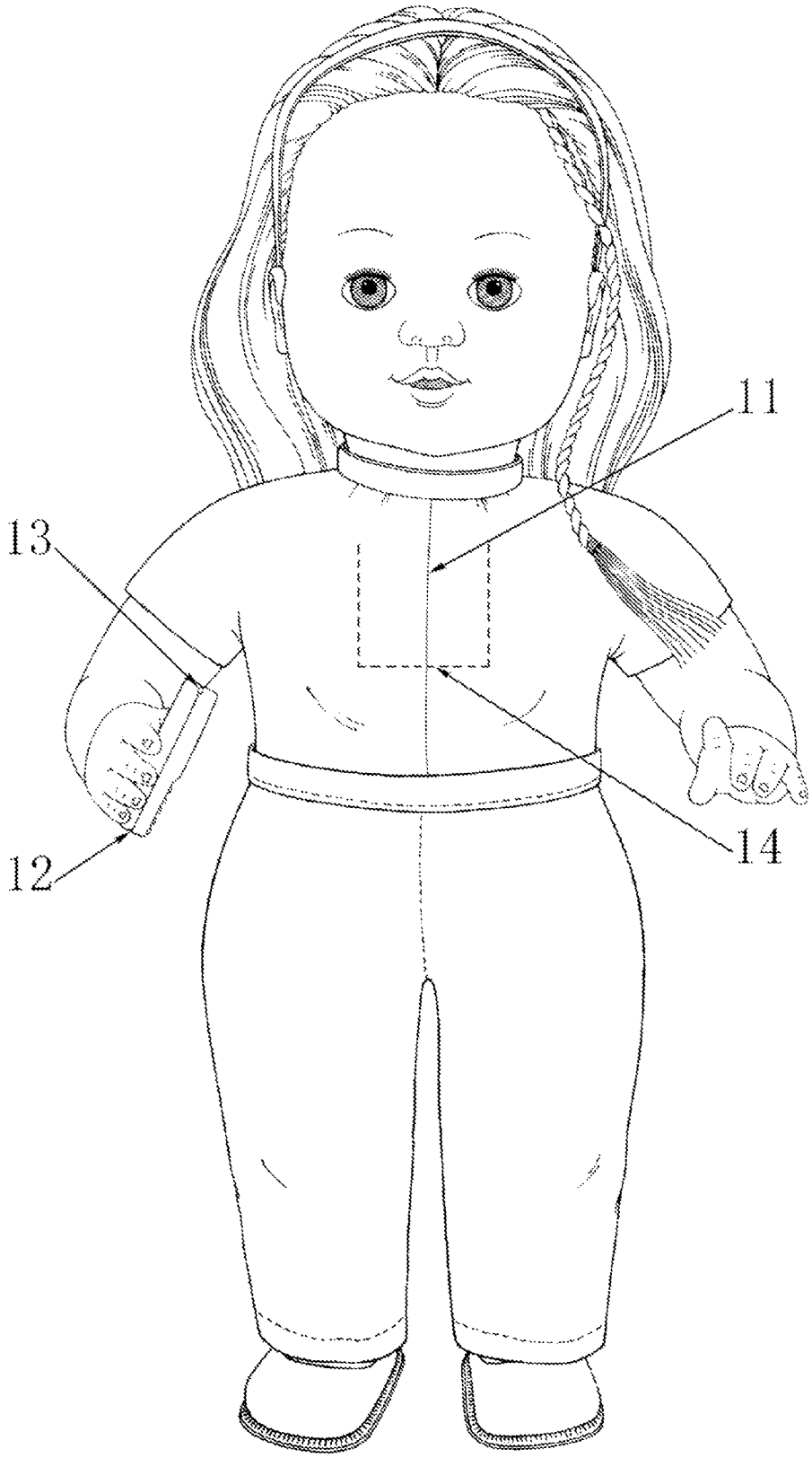
FIG. 1 is a front view of the doll of the Mobile Phone Doll embodiment.

FIG. 1 is a front view of the doll of the Mobile Phone Doll embodiment. The doll itself resembles a young girl. Inside the upper chest of the doll 11, there is an infrared receiver (not shown). The right hand of the doll is holding a device that looks like a mobile phone 12. At the end of the mobile phone is a light emitting diode 13. The opposite hand contains a hidden button in the hand (not shown). Further, below the infrared receiver, inside of the lower chest of the doll 14, is a speaker (not shown).

Figure 2:
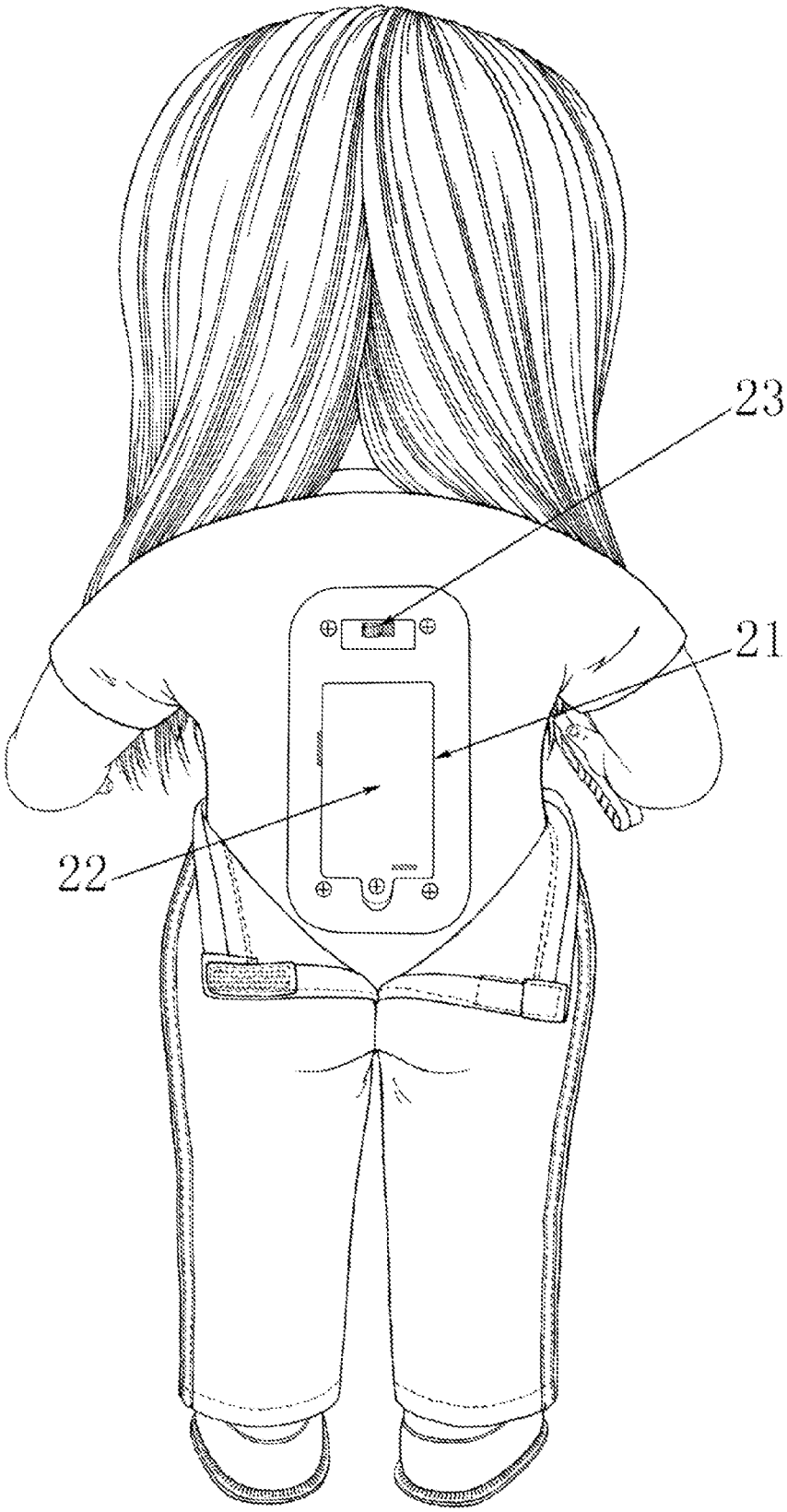
FIG. 2 is a back view of the doll of the Mobile Phone Doll embodiment.

FIG. 2 is a back view of the doll of the Mobile Phone Doll embodiment. The battery pack 21 is located in the back of the doll. The AA batteries (not shown) may be replaced by removing the battery pack cover 22. Above the battery pack 21 is a three-way switch 23.

Figure 3:
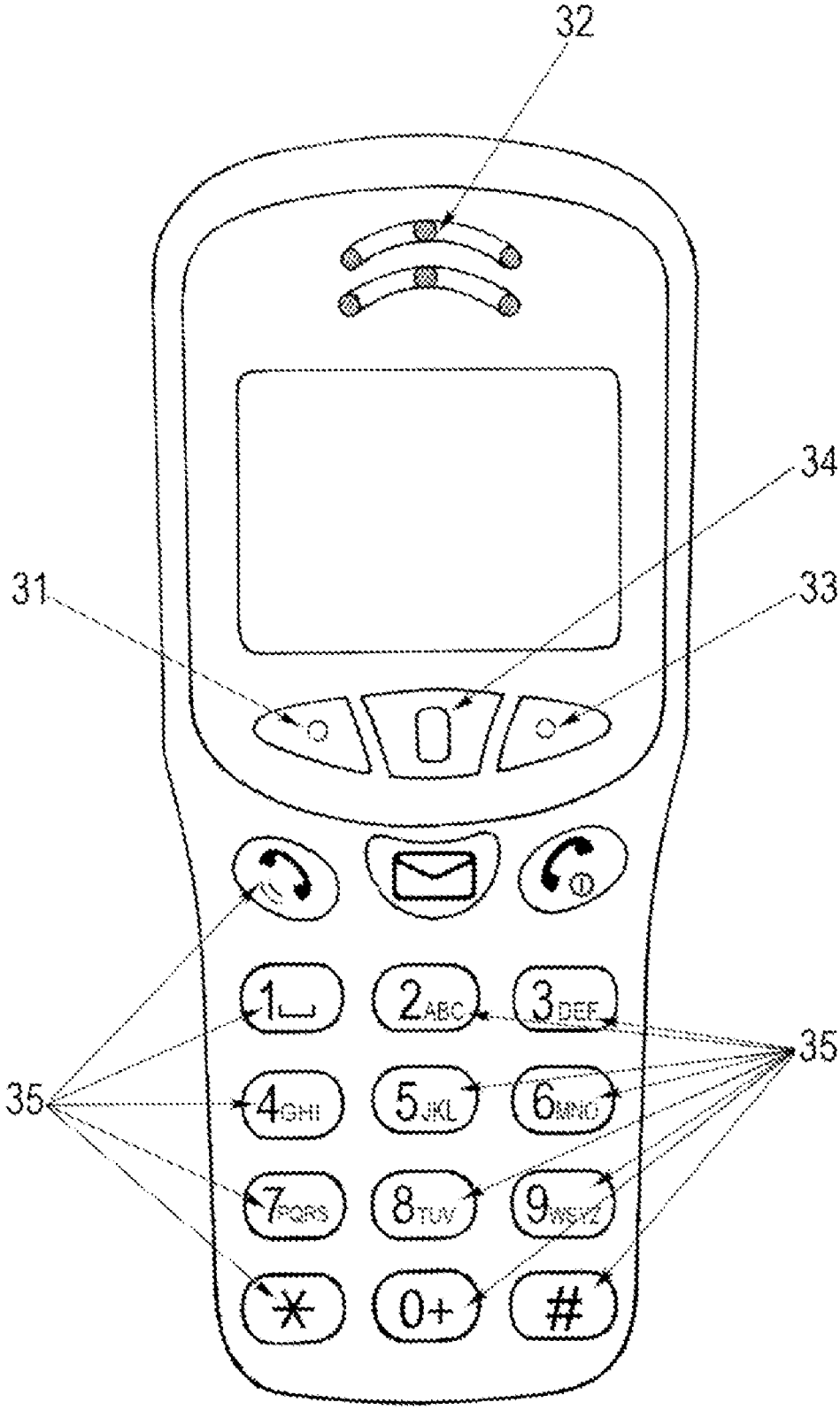
FIG. 3 is a front view of the remote control of the Mobile Phone Doll embodiment.

FIG. 3 is a front view of the remote control of the Mobile Phone Doll embodiment. The remote control comprises a send button 31 that, when pressed, causes the remote control and the doll to interact, creating a conversation between the two. Sound from the remote control is emitted from a speaker 32. The remote control further comprises an end button 33 that, when pressed, ends the conversation between the remote control and the doll. Between the send button 31 and the end button 33 is a voicemail button 34. When the voicemail button 34 is pressed, the remote control and the doll do not interact, but sound is nonetheless emitted from the speaker 32. Specifically, the speaker 32 emits a recording that sounds as if the doll left the user a voicemail. There are additional remaining buttons 35 or keys that also do not cause the remote control and the doll to interact, but do cause the speaker 32 to emit sound, similar to that of a real mobile phone number pad.

Figure 4:
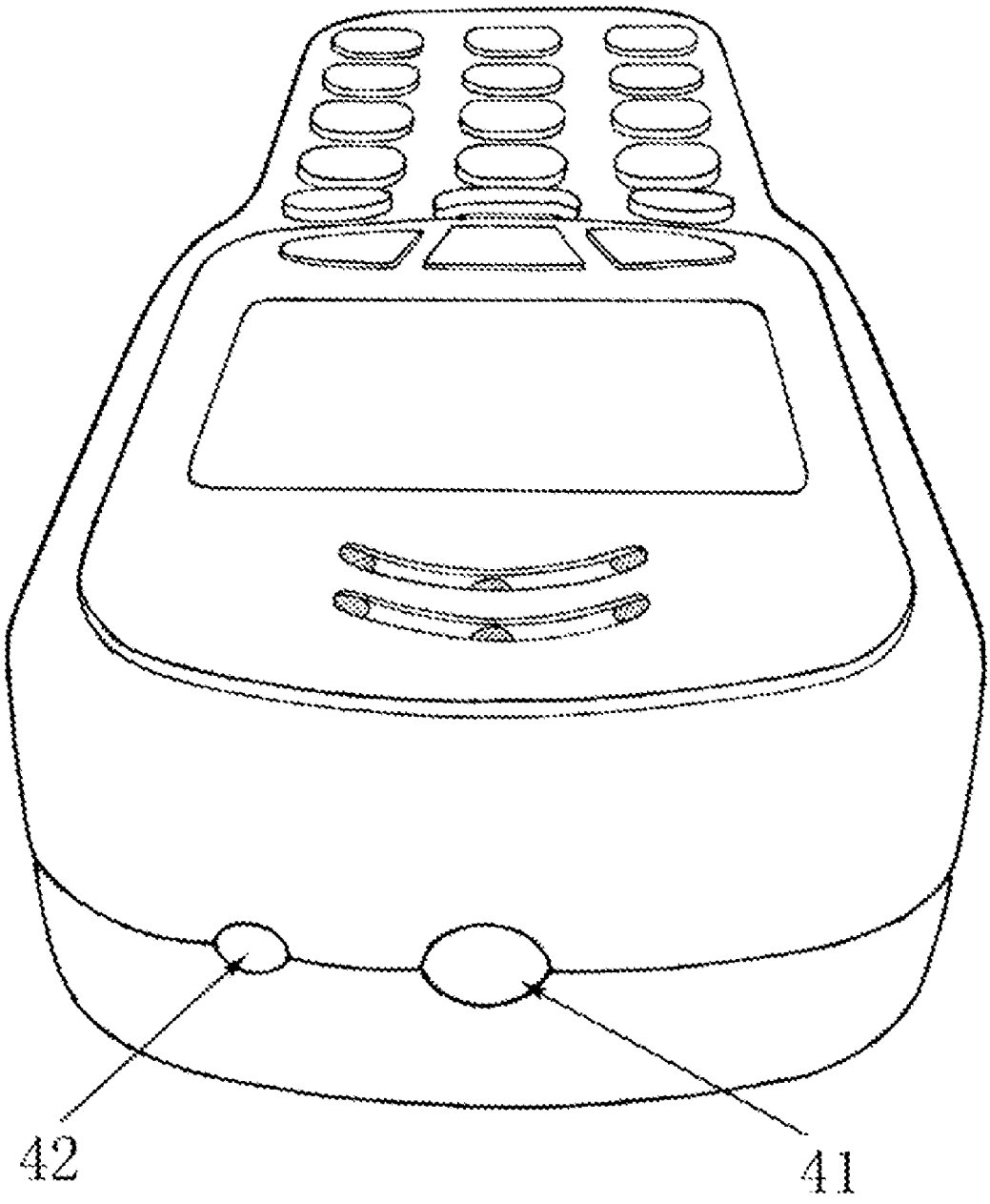
FIG. 4 is a top view of the remote control of the Mobile Phone Doll embodiment.

FIG. 4 is a top view of the remote control. The remote control interacts with the doll by transmitting infrared light from an infrared transmitter 41. There can also be an additional infrared light transmitter located on the bottom of the remote control (not shown). The remote control also comprises a light emitting diode 42 that can light up at various times, such as when the remote control and the doll are interacting or if the speaker (not shown) is emitting sound.

Figure 5:
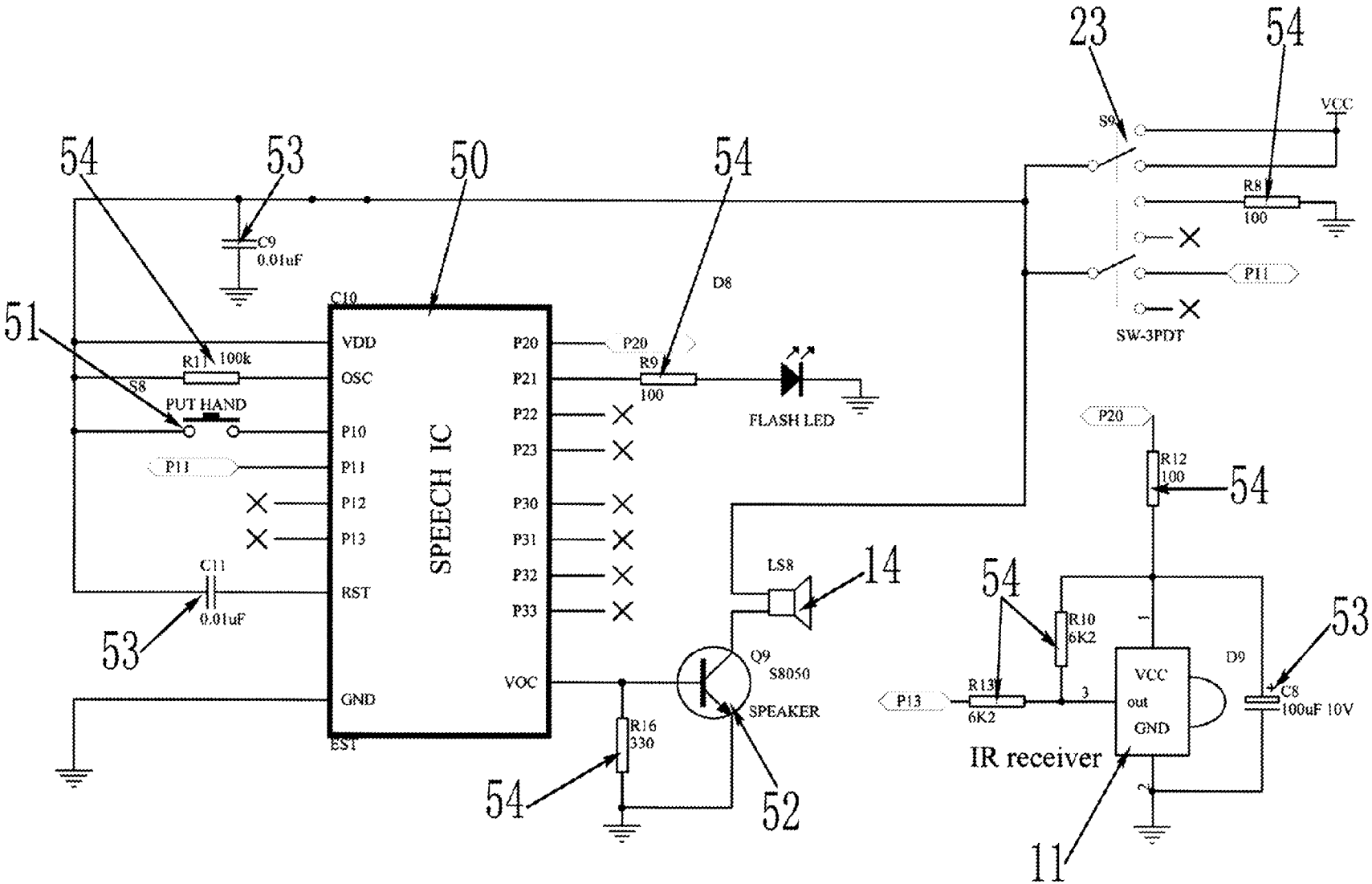
FIG. 5 is a circuit diagram of the doll of the Mobile Phone Doll embodiment.

FIG. 5 is a circuit diagram of the doll of the Mobile Phone Doll embodiment. The circuit has a working voltage of 4.5 volts. An integrated circuit 50 is connected to various electronic components and accepts input from some components and sends output to other components. A button in the hand of the doll 51 is connected to the integrated circuit 50. The three-way switch 23 is also connected to the circuit, and as described above, switches the doll between the on position, off position, and the limited-function position. The circuit also comprises a speaker 14, which emits sound based on input from the integrated circuit 50, and an infrared receiver 11, which sends input to the integrated circuit 50 based on infrared light that it receives. Input from the button in the hand of the doll 51 goes to the integrated circuit 50. Based upon the input that the integrated circuit 50 receives, it produces one or more outputs. As a part of this circuit, there is a NPN transistor 52 as well as capacitors 53 and resistors 54.

Figure 6:
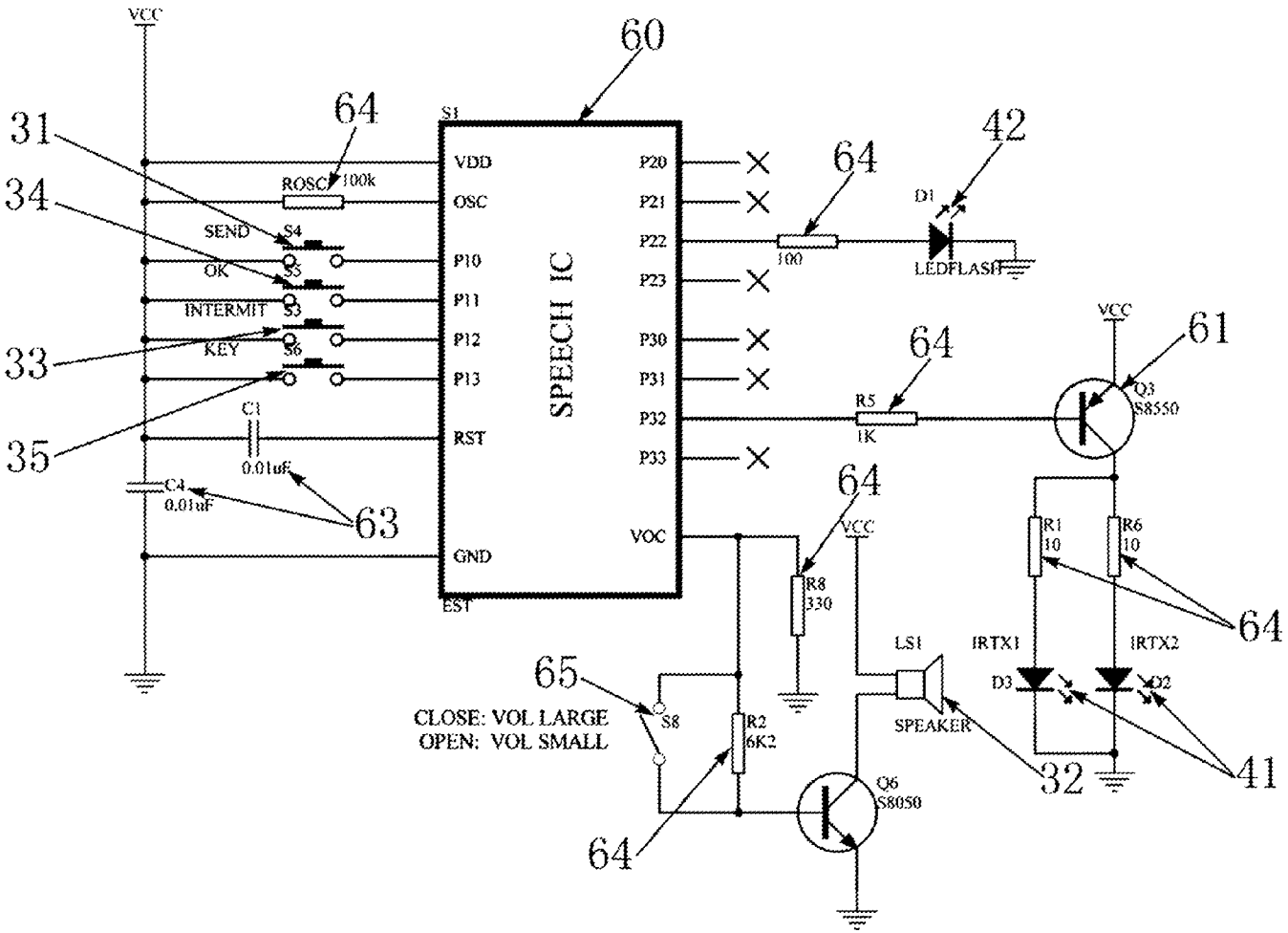
FIG. 6 is a circuit diagram of the remote control of the Mobile Phone Doll embodiment.

FIG. 6 is a circuit diagram of the remote control of the Mobile Phone Doll embodiment. The circuit has a working voltage of 3.0 to 4.5 volts. An integrated circuit 60 is connected to various electronic components and accepts input from some components and sends output to other components. There is an LED light 42, two infrared transmitters 41, and a speaker 32 connected to the circuit, which all receive input from the integrated circuit 60. The circuit also includes a send button 31, voicemail button 34, end button 33, and one or more remaining buttons 35 or keys, all of which are input to the integrated circuit and cause the integrated circuit 60 to produce one or more outputs. As a part of this circuit, there are a PNP transistor 61 and a NPN transistor 62, as well as capacitors 63 and resistors 64. Finally, there is a switch 65 that, when closed, increases the volume of the sound emitted from the speaker 32.

Figure 7:
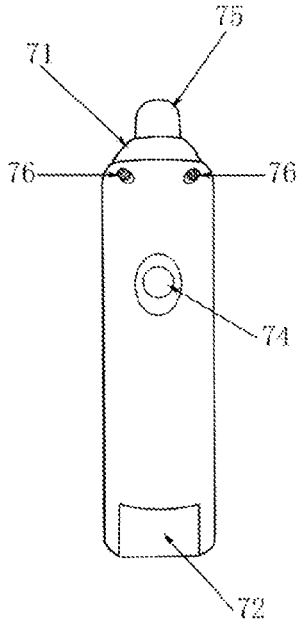
FIG. 7 is a perspective view of the remote control of the Birthday Doll embodiment.
Figure 7:
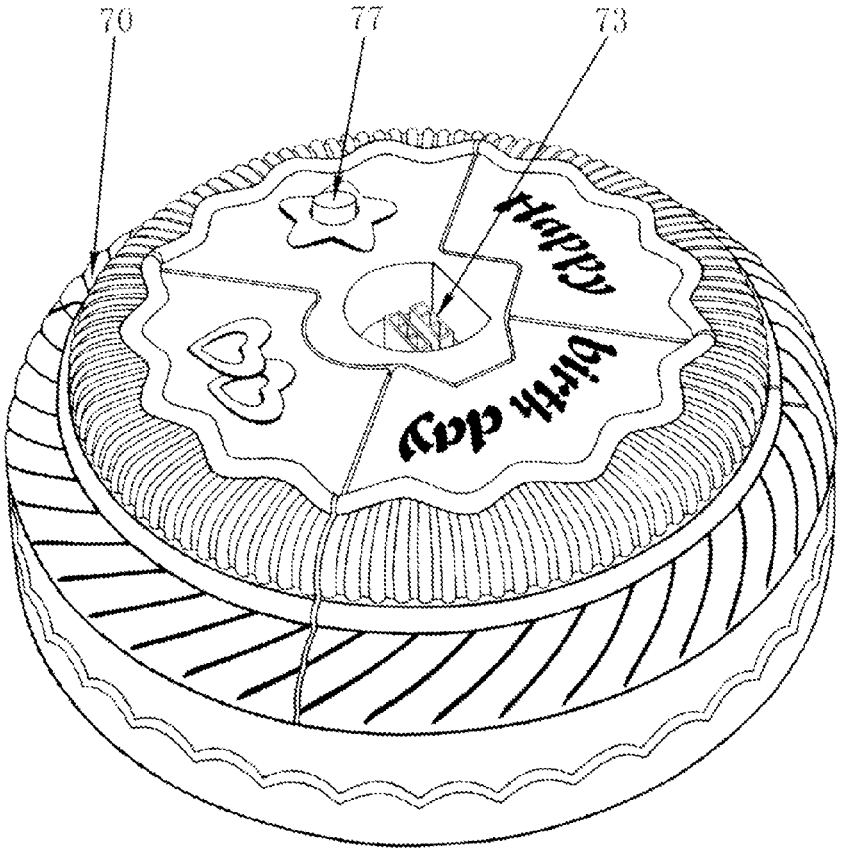

FIG. 7 is a perspective view of the remote control of the Birthday Doll embodiment. The candle portion 71 is removable from the base portion 70. The bottom of the candle portion 72 fits into the middle of the base portion 73. The candle portion includes an infrared transmitter 74, an LED 75, and openings 76 so that the microphone (not shown) located inside of the candle portion 72 can more easily receive sound input. The base portion 70 also includes a microphone button 77, which, when depressed, activates the microphone inside of the candle portion 72.

Figure 8:
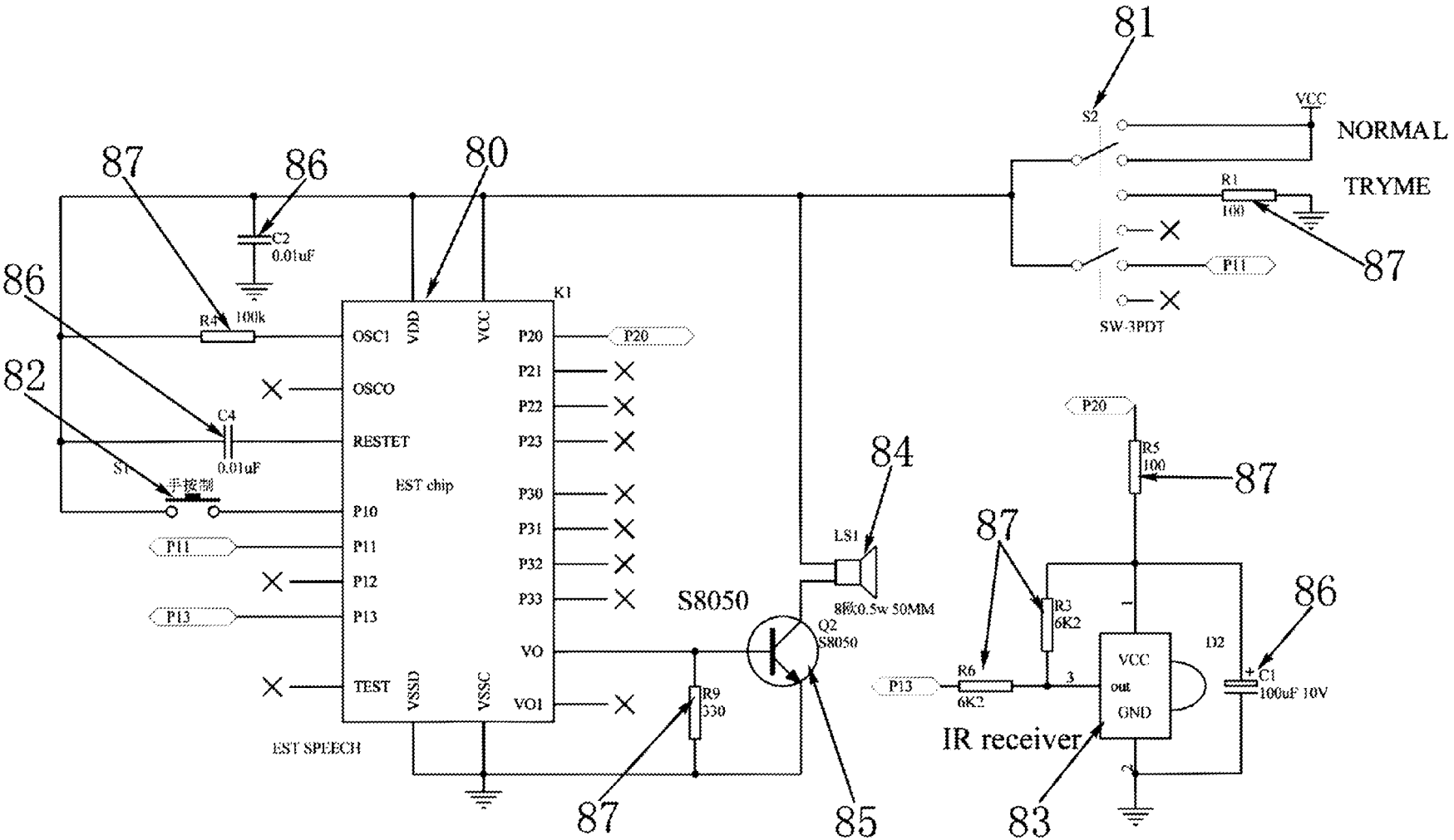
FIG. 8 is a circuit diagram of the doll of the Birthday Doll embodiment.

FIG. 8 is a circuit diagram of the doll of the Birthday Doll embodiment. The circuit has a working voltage of 4.5 volts. An integrated circuit 80 is connected to various electronic components and accepts input from some components and sends output to other components. A three-way switch 81 is also connected to the circuit, and as described above, switches the doll between the on position, off position, and the limited-function position. The integrated circuit 80 receives input from a button in the hand of the doll 82 and an infrared receiver 83. The integrated circuit then sends output to a speaker 84. As a part of this circuit, there is a NPN transistor 85, as well as capacitors 86 and resistors 87.

Figure 9:
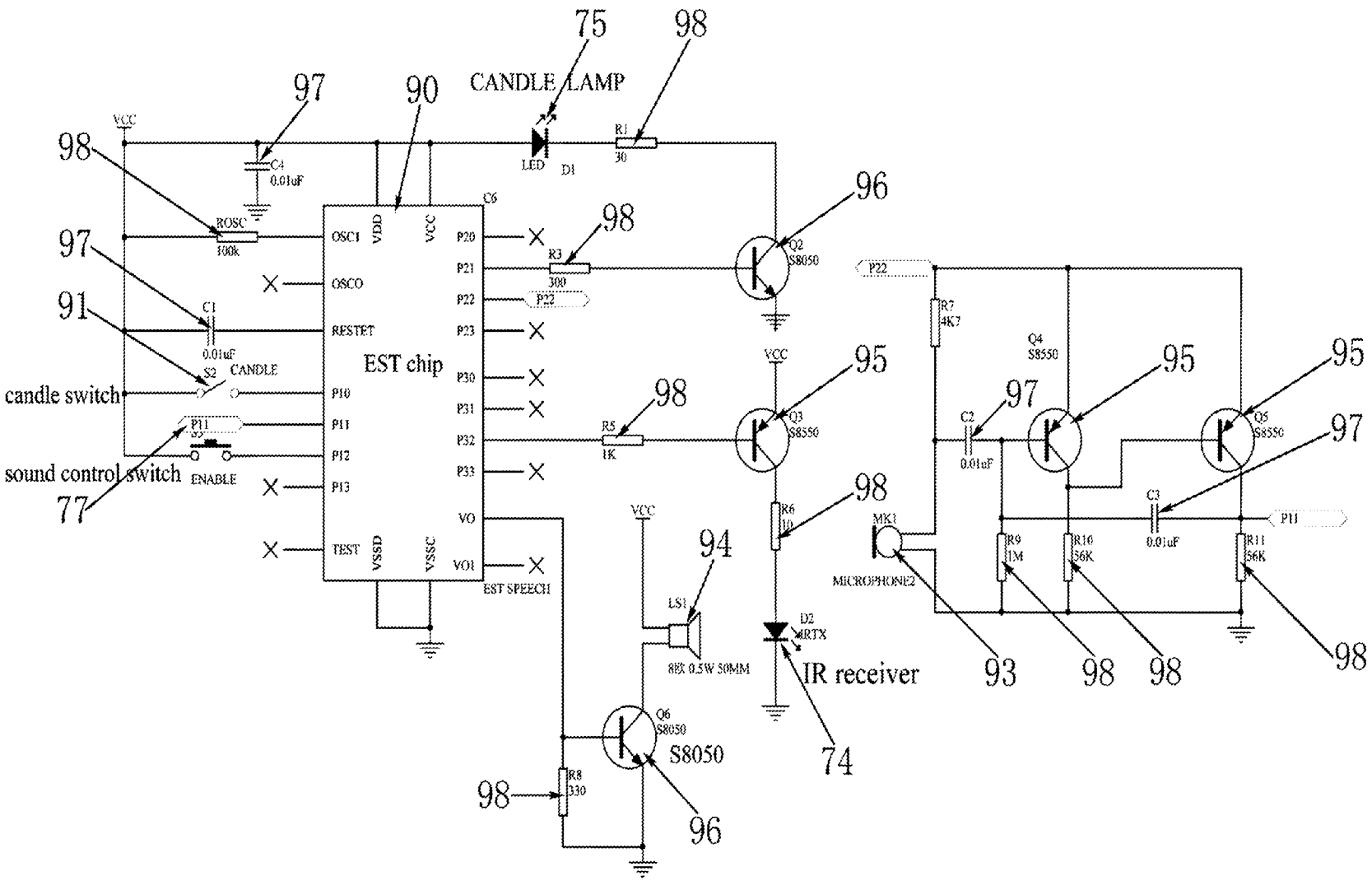
FIG. 9 is a circuit diagram of the remote control of the Birthday Doll embodiment.

FIG. 9 is a circuit diagram of the remote control of the Birthday Doll embodiment. The circuit has a working voltage of 3.0-4.5 volts. An integrated circuit 90 is connected to various electronic components and accepts input from some components and sends output to other components. The integrated circuit 90 receives input from a candle switch 91, microphone activating button 77, and microphone 93. The integrated circuit 90 then sends output to a speaker 94, infrared transmitter 74, or LED 75 based upon the input that it receives. As a part of this circuit, there are PNP transistors 95, NPN transistors 96, capacitors 97, and resisters 98.

What I claim is:

1. A child's toy comprising a doll, where the doll is in the shape of a humanoid figure, and where the doll comprises a power source, a speaker, an electromagnetic receiver capable of receiving electromagnetic transmissions, and an integrated circuit, where the integrated circuit is capable of processing input from the electromagnetic receiver and sending output to the speaker, and a remote control, where the remote control can be held by the user and where the remote control is not physically attached to the doll, and where the remote control comprises one or more buttons that are interactive, known as interactive buttons, where the interactive button, when pressed, causes the remote control to interact with the doll, and where the remote control further comprises a power source, a speaker, an electromagnetic transmitter capable of transmitting electromagnetic transmissions, and an integrated circuit capable of processing input from a button and sending output to an electromagnetic transmitter, and where the doll and the remote control interact by a series of one or more pre-programmed electromagnetic transmissions that is transmitted from the remote control, where the doll is capable of receiving these transmissions and when the doll receives these electromagnetic transmissions, the doll then emits a series of one or more pre-programmed sounds based upon these electromagnetic transmissions received from the remote control where the remote control further comprises one or more non-interactive buttons, where the non-interactive button, when pressed, causes a series of one or more pre-programmed sounds to be emitted from the remote control, but does not cause the remote control to interact with the doll, where one of the interactive buttons, when pressed, ceases all pre-programmed functions currently being performed by the remote control, if any, and causes an electromagnetic transmission to be transmitted from the remote control and where the doll is able to receive this electromagnetic transmission, and upon receiving this transmission, the doll ceases all pre-programmed functions currently being performed, if any.

2. The child's toy of claim 1, where the sounds emitted from the doll and the remote control are words, music, or a combination thereof.

3. The child's toy of claim 1, where the remote control further comprises an object capable of producing light.

4. The child's toy of claim 3, where the object capable of producing light of the remote control produces light when the remote control and the doll interact.

5. The child's toy of claim 3, where the object capable of producing light of the remote control produces light when the remote control emits sound.

6. The child's toy of claim 1, where the doll further comprises a three-way switch, where the switch can be in an off position, an on position, or a limited-function position, where, while the switch is in the on position, the power supply of the doll supplies electricity to all of the various components of the doll that require electricity to operate, while the switch is in the off position, the power supply of the doll does not supply power to any of the various components of the doll that require electricity to operate, and when the switch is in the limited-function position, the power supply of the doll supplies electricity to some, but not all, of the various components of the doll that require electricity to operate causing the doll to not interact with the remote control.

7. The child's toy of claim 6, where the doll further comprises a button located in one of the hands of the doll, where the button is not visible on the surface of the hand, and where the button, when pressed and when the three-way switch is in the limited-function position, causes the doll to emit sound.

8. The child's toy of claim 1, where the doll will automatically enter into a low-power mode from a normal-power mode after a finite period of time, where, while in the low-power mode, will not interact with the remote control.

9. The child's toy of claim 8, where the doll further comprises a button located in one of the hands of the doll, where the button is not visible on the surface of the hand, and where the button, when pressed and the doll is in a low-power mode, causes the doll leave the low-power mode and return to a normal-power mode.

10. The child's toy of claim 1, where the electromagnetic transmitter of the remote control is an infrared light transmitter and where the electromagnetic receiver of the doll is an infrared light receiver, and where the remote control and the doll interact via transmission of infrared light from the remote control to the doll.

11. The child's toy of claim 1, where the remote control comprises at least two interactive buttons, where one of the interactive buttons, when pressed, interrupts any pre-programmed functions currently being performed by the remote control, if any, and causes a different series of one or more pre-programmed sounds to be emitted from the remote control, and a different series of one or more pre-programmed electromagnetic transmissions to be transmitted from the remote control, and where the doll is capable of receiving these electromagnetic transmissions, and upon the doll receiving one or more of these transmissions, interrupts any pre-programmed functions currently being performed by the doll, if any, and causes a different series of one or more pre-programmed sounds to be emitted from the doll based upon the electromagnetic transmission received from the remote control.

12. The child's toy of claim 1, where the doll further comprises a device that resembles a mobile phone, where the device that resembles a mobile phone is held in one of the doll's hands, and where the device that resembles a mobile phone comprises an object capable of producing light.

13. The child's toy of claim 12, where the object capable of producing light of the device that resembles a mobile phone produces light when the doll and the remote control interact.

14. The child's toy of claim 12, where the object capable of producing light of the device that resembles a mobile phone produces light when the doll emits sound.

15. The child's toy of claim 1, where one of the interactive buttons of the remote control is a removable interactive switch, where the removable interactive switch can be completely removed from the remote control, and where the removable interactive switch is closed by connecting the removable interactive switch to the remote control, thereby causing the doll and the remote control to interact.

16. The child's toy of claim 15, where the removable interactive switch comprises the electromagnetic transmitter of the remote control.

17. The child's toy of claim 15, where the removable interactive switch comprises an object capable of producing light.

18. The child's toy of claim 17, where the object capable of producing light of the removable interactive switch produces light when the remote control emits sound.

19. The child's toy of claim 17, where the object capable of producing light of the removable interactive switch produces light when the doll and the remote control interact.

20. The child's toy of claim 15, where the removable interactive switch comprises a microphone.

21. The child's toy of claim 20, where the remote control further comprises a microphone activating button, where, while pressed, activates the microphone.

22. The child's toy of claim 21, where, when the microphone is activated and receives input in the form of sound, the doll and the remote control interact.

23. A child's toy comprising a doll, where the doll resembles a small child or infant, and where the doll comprises a device that resembles a mobile phone, where the device that resembles a mobile phone is held in one of the doll's hands, and where the device that resembles a mobile phone comprises an object capable of producing light, and where the doll further comprises a button in the hand opposite of the hand that is holding the device that resembles a mobile phone, an electromagnetic receiver, a speaker, a power source, an integrated circuit, and a three-way switch where the button in the hand of the doll may be pressed by squeezing the hand of the doll but the button is not visible on the surface of the hand of the doll, where the three-way switch can be in the on, off, or limited-function positions, where the switch, when in the off position, causes the power supply to not supply electricity to any of the various components of the doll that require electricity to operate, when in the limited function position, electricity is supplied from the power source to the various components of the doll that require electricity, but the doll does not interact with the remote control, and when in the on position, electricity is supplied from the powered source to the various components of the doll that require electricity, and the remote control interacts with the doll, where the integrated circuit of the doll is capable of and does store audio data, and where the integrated circuit is capable of processing input from various sources and creating output for various components, where the electromagnetic receiver is capable of receiving electromagnetic transmissions, a remote control, where the remote control resembles a mobile phone, and where the remote control comprises an electromagnetic transmitter, a power source, four or more buttons, an integrated circuit, and a speaker, where the electromagnetic transmitter is capable of producing electromagnetic transmissions, where these transmissions, when received by the doll, cause the remote control and the doll to interact, where the integrated circuit of the remote control is capable of and does store audio data, and where the integrated circuit is capable of processing input from various sources and creating output for various components, where two of the four or more buttons are interactive buttons, where, when pressed, cause the remote control to interact with the doll, where one of these buttons is a send button and another one of these buttons is an end button, where the doll and the remote control interact by a series of one or more pre-programmed electromagnetic transmissions that is transmitted from the remote control, where the doll is capable of receiving these transmissions and when the doll receives these electromagnetic transmissions, the doll then emits a series of one or more pre-programmed sounds based upon these electromagnetic transmissions received from the remote control, where the sounds emitted from both the remote control and the doll are in the form of words, music, or both, and where two of the four or more buttons are non-interactive buttons, where, when pressed, cause the remote control to emit sound, but does not cause the remote control to interact with the doll, and where one of these non-interactive buttons is a voicemail button, where the voicemail button, when pressed, causes the speaker of the remote control to emit sound, where this sound is in the form of words, music, or both, where, when the end button of the remote control is pressed, the current interaction between the remote control and the doll is interrupted and ceases to continue, and a new interaction begins between the remote control and the doll, where the doll, when it has not received any electromagnetic transmissions from the remote control for a finite period of time, enters into a low-power mode from a normal-power mode, where, when in the low-power mode, the doll will conserve power and electricity will not be supplied to all of the various components of the doll that require electricity causing the doll to not interact with the remote control, and where, when the button in the hand of the doll is pressed, the doll will leave the low-power mode and enter into the normal-power mode, where the power supply of the doll supplies electricity to all of the various components of the doll that require electricity and the doll will once again interact with the remote control.

24. The child's toy of claim 23, where the electromagnetic transmissions are in the form of infrared light, where the electromagnetic receiver of the doll is an infrared light receiver, and where the electromagnetic transmitter of the remote control is an infrared light transmitter.

25. A child's toy comprising a doll, where the doll comprises a button in one of its hands, an electromagnetic receiver, a speaker, a power source, an integrated circuit, and a three-way switch where the button in the hand of the doll may be pressed by squeezing the hand of the doll but the button is not visible on the surface of the hand of the doll, where the three-way switch can be in the on, off, or limited-function positions, where the switch, when in the off position, causes the power supply to not supply electricity to any of the various components of the doll that require electricity to operate, when in the limited function position, electricity is supplied from the power source to the various components of the doll that require electricity, but the doll does not interact with the remote control, and when in the on position, electricity is supplied from the powered source to the various components of the doll that require electricity, and the remote control interacts with the doll, where the integrated circuit of the doll is capable of and does store audio data, where the electromagnetic receiver is capable of receiving electromagnetic transmissions, where the integrated circuit of the doll is capable of and does store audio data, and where the integrated circuit is capable of processing input from various sources and creating output for various components, a remote control, where the remote control comprises an electromagnetic transmitter, a power source, a removable interactive switch, a microphone activating button, an integrated circuit, a microphone, and a speaker, where the electromagnetic transmitter is capable of producing electromagnetic transmissions, where these transmissions, when received by the doll, cause the remote control and the doll to interact, where the integrated circuit of the remote control is capable of and does store audio data, and where the integrated circuit is capable of processing input from various sources and creating output for various components, where the removable interactive switch comprises an electromagnetic transmitter, an object capable of producing light, and a sound sensor, and where the removable interactive switch can be completely removed from the remote control, and where the removable interactive switch is closed by connecting the removable interactive switch to the remote control, and where, when the removable interactive switch is pressed, the doll and the remote control interact, and where the microphone activating button, when pressed, activates the microphone, and where, when the microphone is activated and receives input in the form of sound, the doll and the remote control interact, and where the doll and the remote control interact by a series of one or more pre-programmed electromagnetic transmissions that is transmitted from the remote control, where the doll is capable of receiving these transmissions and when the doll receives these electromagnetic transmissions, the doll then emits a series of one or more pre-programmed sounds based upon these electromagnetic transmissions received from the remote control, where the sounds emitted from both the remote control and the doll are in the form of words, music, or both, and where the doll, when it has not received any electromagnetic transmissions from the remote control for a finite period of time, enters into a low-power mode from a normal-power mode, where, when in the low-power mode, the doll will conserve power and electricity will not be supplied to all of the various components of the doll that require electricity causing the doll to not interact with the remote control, and where, when the button in the hand of the doll is pressed, the doll will leave the low-power mode and enter into the normal-power mode, where the power supply of the doll supplies electricity to all of the various components of the doll that require electricity and the doll will once again interact with the remote control.

26. The child's toy of claim 25, where the electromagnetic transmissions are in the form of infrared light, where the electromagnetic receiver of the doll is an infrared light receiver, and where the electromagnetic transmitter of the remote control is an infrared light transmitter.

* * * * *